United States Patent [19]

Kubon et al.

[11] Patent Number: 4,714,106

[45] Date of Patent: Dec. 22, 1987

[54] METHOD OF HORIZONTAL CONTINUOUS CASTING

[75] Inventors: Achim Kubon, Neukirchen; Peter Voss-Spilker, Kempen, both of Fed. Rep. of Germany

[73] Assignee: Mannesmann AG, Duesseldorf, Fed. Rep. of Germany

[21] Appl. No.: 751,545

[22] Filed: Jun. 27, 1985

[30] Foreign Application Priority Data

Jul. 16, 1984 [DE] Fed. Rep. of Germany ..... 3426168

[51] Int. Cl.[4] ..... B22D 11/128

[52] U.S. Cl. ..... 164/484

[58] Field of Search ..... 164/484, 478, 416

[56] References Cited

U.S. PATENT DOCUMENTS 3,354,936 11/1967 Atkin ..... 164/484

3,669,176 6/1972 Krall et al. ..... 164/484

4,211,270 7/1980 Shinopulos et al. ..... 164/484

FOREIGN PATENT DOCUMENTS 3109907 10/1982 Fed. Rep. of Germany ..... 164/484

*Primary Examiner*—Nicholas P. Godici

*Assistant Examiner*—Samuel M. Heinrich

*Attorney, Agent, or Firm*—Ralf H. Siegemund

[57] ABSTRACT

A method for continuous casting of steel in a horizontal casting mode and using a cycle being comprised of an extraction stroke, a holding period, a retraction stroke and another holding period, the retraction speed, the retraction length and the holding period between an extraction stroke and a retraction stroke are maintained constant; and extraction speed and extraction length as well as the holding period between a retraction stroke and the next following extraction stroke are varied for adaptive purposes.

2 Claims, 2 Drawing Figures

METHOD OF HORIZONTAL CONTINUOUS CASTING

BACKGROUND OF THE INVENTION

The present invention relates to the continuous casting of metal, particularly steel in the horizontal mode whereby particularly molten metal is fed into a horizontally oriented mold for continuous casting and being cooled and wherein a casting or ingot is extracted from the mold under consideration of particular conditions such as extraction speed, extraction length, retraction speed, retraction length and holding periods in between the alternatingly occuring extraction and retraction steps of the casting.

Horizontal casting of metal on a continuous basis offers certain problems. In most instances certain production stroke marker cracks or grooves are observed which in certain cases particularly for some high quality steel grades render the process useless. In case the expert applies particular careful handling to these grades of steel the throughput for the casting process reduces.

It is known (see for example Berg- und Huettenmannische Monatshefte 1983, Volume 3, Pages 65–71) to attempt to optimize the various parameters involved in the casting process. It has also been considered to avoid the drawback of marker formation on account of the extraction process by increasing the frequency of extraction from 100 per minute, as practiced presently, to 200 or 300 cycles/minute in order to avoid skin rupture cracks on account of stroke markers or the like. These high frequencies, however, are difficult to obtain by means of a conventional extraction machines using roller drives; and the problem is increased if the cross section of the casting is larger and the overall casting weight/length is very high.

In the case of roller drives the force is applied to the casting in practically pointlike fashion which in the case of high speeds, large cross section and high weights means considerable expenditure of force which in turn can readily deform the casting in view of the fact that at the zone of engagement the skin is still very thin. It has been tempting to use a multiroller drive for this purpose but the problem here is the lack of adequate synchronism.

From the point of view of apparatus and equipment certain hydraulically operated extraction machines are known, e.g. through the German printed patent No. 32 06 501 corresponding to U.S. patent application Ser. No. 455,465 filed on Jan. 03, 1983. The casting is gripped by means of brackets or the like and without play move the casting rather exactly. Such an extraction machine does indeed permit trouble-free optimization of the casting method.

The various parameters which were relevant for horizontal casting of metal have been mentioned above. These parameters are used to determine the casting speeds, the rate of intermittency of extraction etc. These parameters are used to calculate casting speed and cycle time of extraction. Moreover, the additional factors such as the material of the mold, its shape, the cooling condition have to be considered. The casting material itself i.e. the metal is an important parameter; also electromagnetic stirring of the liquidous core is to be considered.

DESCRIPTION OF THE INVENTION

It is an object of the present invention to provide a new and improved method for continuously casting metal such as steel in the horizontal mode wherein a stable solidification skin is obtained and the throughput is larger than it was possible in the past.

In accordance with the preferred embodiment of the present invention it is suggested to hold constant retraction speed, retraction length and holding period in between a forward and a reverse stroke movement and that the extraction speed, the extraction length and the holding period between a retraction step and the next forward step stroke are varied within limits. Using these principles it is guaranteed that cracks will not occur and that the process can indeed be optimized with regard to quality and quantity so that in fact extraction frequencies of more than 150 cycles/minute are not necessary. Maintaining the principles taught by this invention permits moreover that the friction and acceleration forces can be overcome. A larger extraction length moreover is instrumental in producing a larger movement in the molten material which enhances material exchange inside the casting and that in turn means that any cracks that may have occured for other reasons can, so to speak, be healed. It was also observed that the separation (segregation of alloy components) depth was reduced, a stable solidification skin and crack-free texture was attained.

In furtherance of the invention it is suggested to provide an extraction length to holding period ratio as between retraction and advance of at least 80:1(in mm/sec) or even larger. This method avoids so called extraction stroke cracks which in the past have either reduced the quality or even rendered portions unusuable.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings FIG. 1 is an experimentally ascertained diagram showing as stated in the ordinate the distance (depth) from the surface, and the abcissa indicates casting extraction stroke length vs holding time in mm/s. The crosses indicate test points whose cracks have been found, the circles indicate test points without cracks, possible only some separation. As one can see for a relatively long ratio of a lifting length vs holding time, up to 80 mm/sec; the material is prone to in exhibit cracks of the material near the surface while more or less to the right of the limit line and for ratios larger than 80 practically no cracks occur in the surface near region. Certain precipitation may have occurred to some extent but basically the zone is crack-free.

A machine for carrying out the method of the invention is disclosed for example in German patent No. 32 06 50 corresponding to U.S. patent application No. 455,465, filed Jan. 03, 1983. As far as the basic method is concerned, a full cycle can be regarded as being comprised of a forward pulling or extraction stroke followed by certain holding period followed by a retraction stroke followed by another holding period which completes one cycle and the next cycle begins with another pulling stroke. Now, in accordance with the principle of the invention the holding period between the extraction and pulling stroke and the next retraction stroke is to remain constant, and the retraction speed and retraction length is likewise to remain constant. On the other hand the holding period between a retraction stroke and the next extraction and pulling stroke i.e. the holding period that terminates the particular cycle as defined above can be varied if that variation is needed for purposes of optimizing the operation. The extraction or pulling speed as well as the extraction and pulling length can likewise be modified and varied within limits. This constitutes a basic departure from past practice.

Figure 1:
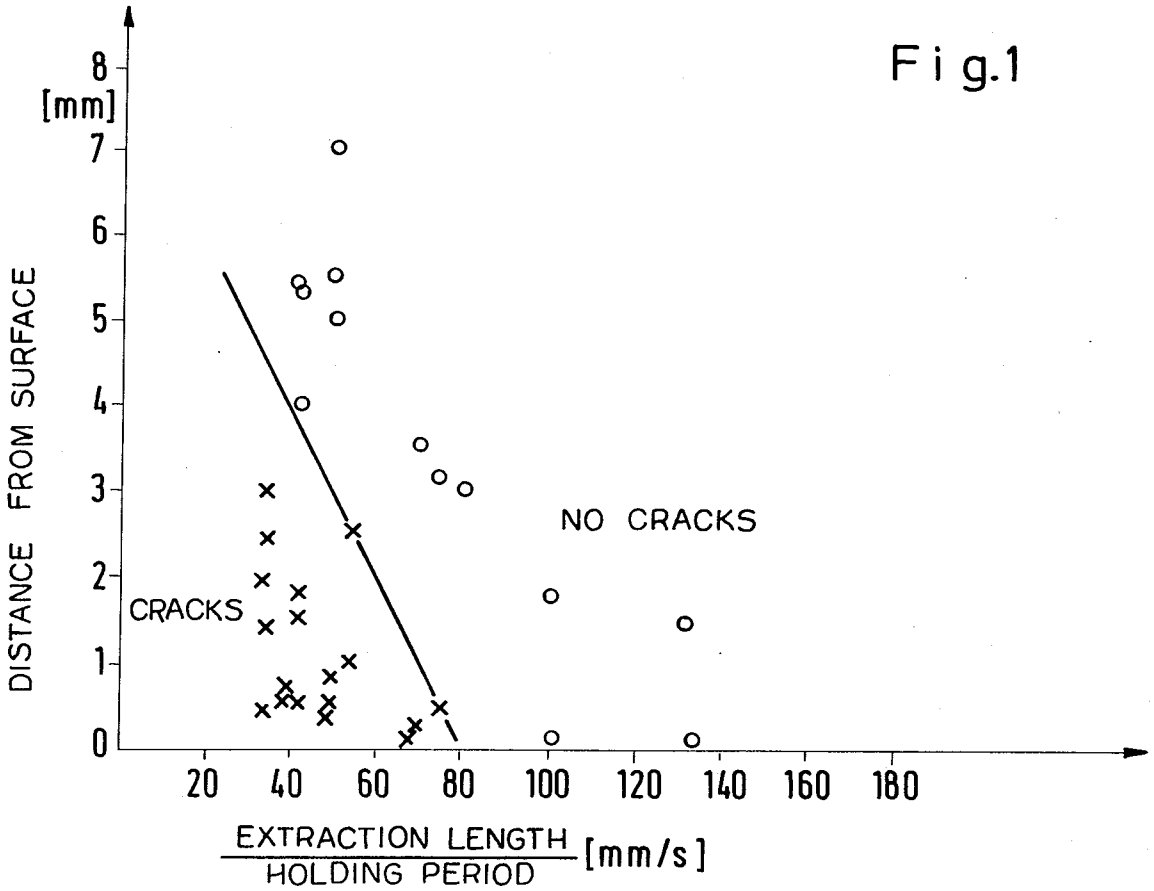
FIG. 1 is a diagram of a variety of tested materials wherein the abscissa indicates the ratio of advance stroke length, vs. holding time, and the ordinate indicates the distance (depth) from the surface.
Figure 2:
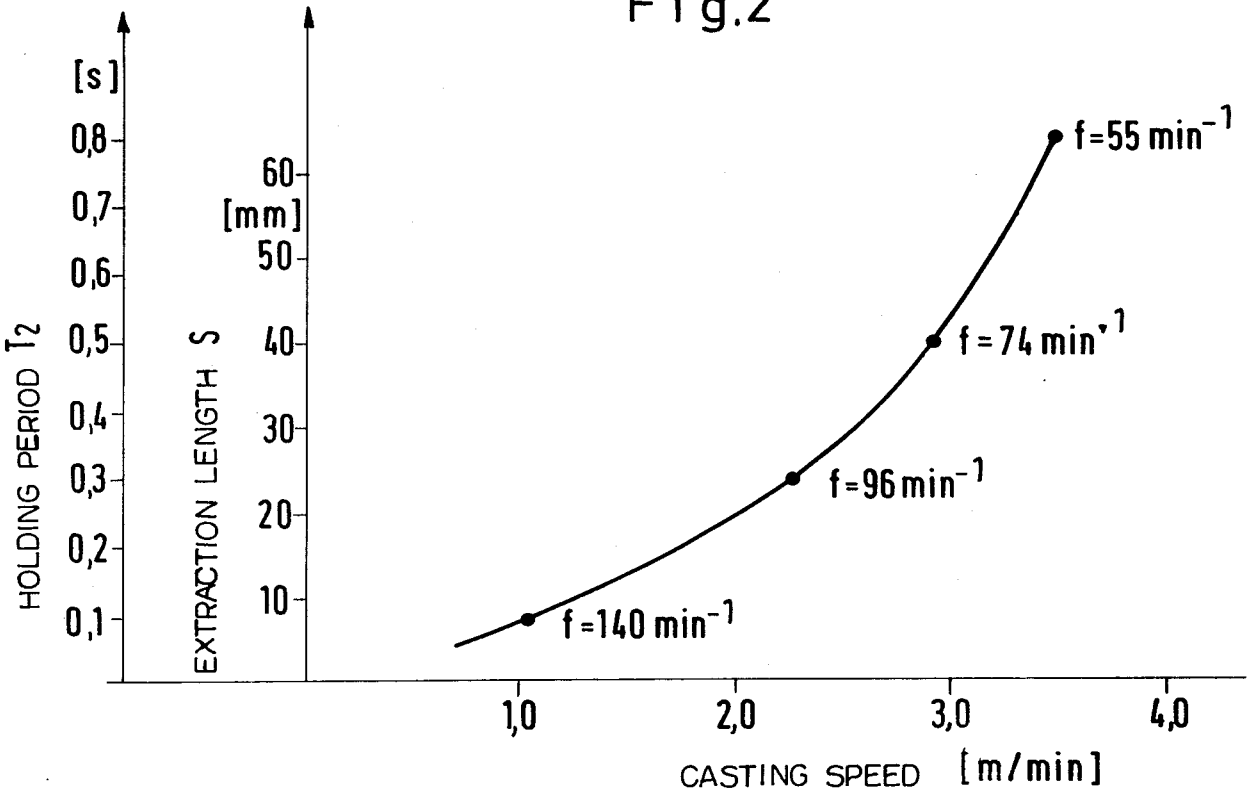
FIG. 2 illustrates a diagram in which the dependency of holding time between forward and retraction and the forward motion is plotted vs. casting speed using several cycle frequencies as parameters.

FIG. 2 illustrates that for corresponding holding periods between a retraction stroke and the next extraction stroke and for corresponding extraction length there is a relationship between increasing extraction length and casting speed such that the number of extraction steps per minute has to decrease for increasing casting speed.

The invention is not limited to the embodiments described above, but all changes and modifications thereof, not constituting departures from the spirit and scope of the invention, are intended to be included.

We claim:

1. In a method for continuous casting of metal in particular steel in a horizontal casting mode and under utilization of a cycle being comprised of an extraction stroke, a first holding period, a retraction stroke and another holding period and wherein extraction pulling is carried out at a particular speed and for a particular length and retraction is carried out at a particular speed and for a particular length, the improvement comprising:

maintaining constant the retraction speed, the retraction length and the first holding period between an extraction stroke and a retraction stroke; and varying extraction speed and extraction length as well as the other holding period between a retraction stroke and the next following extraction stroke.

2. Method as in claim 1 wherein an extraction length to holding period between the other retraction stroke and forward motion is at least 80:1 in mm/sec.

* * * * *